US011289296B2

(12) United States Patent
Minowa et al.

(10) Patent No.: US 11,289,296 B2
(45) Date of Patent: Mar. 29, 2022

(54) CONTACT DEVICE AND RELAY USING THE SAME

(71) Applicant: Omron Corporation, Kyoto (JP)

(72) Inventors: Ryota Minowa, Kumamoto (JP); Hiroyuki Iwasaka, Kumamoto (JP); Naoki Kawaguchi, Kumamoto (JP)

(73) Assignee: Omron Corporation, Kyoto (JP)

( * ) Notice: Subject to any disclaimer, the term of this patent is extended or adjusted under 35 U.S.C. 154(b) by 2 days.

(21) Appl. No.: 16/282,115

(22) Filed: Feb. 21, 2019

(65) Prior Publication Data

US 2019/0304727 A1 Oct. 3, 2019

(30) Foreign Application Priority Data

Mar. 30, 2018 (JP) ..... JP2018-068872

(51) Int. Cl.
*H01H 50/58* (2006.01)
*H01H 50/64* (2006.01)
*H01H 50/54* (2006.01)

(52) U.S. Cl.
CPC ..... *H01H 50/58* (2013.01); *H01H 50/546* (2013.01); *H01H 50/641* (2013.01)

(58) Field of Classification Search
CPC .... H01H 50/546; H01H 50/58; H01H 50/641; H01H 1/2008
See application file for complete search history.

(56) References Cited

U.S. PATENT DOCUMENTS 5,892,194 A * 4/1999 Uotome ..... H01H 1/34 218/68
7,911,304 B2 * 3/2011 Yano ..... H01H 50/043 335/201

(Continued)

FOREIGN PATENT DOCUMENTS

CN 104115248 A 10/2014
CN 105489406 A 4/2016

(Continued)

OTHER PUBLICATIONS

Office Action issued in Chinese Application No. 201910109745.4; dated Nov. 2, 2020 (27 pages).

(Continued)

*Primary Examiner* — Bernard Rojas
(74) *Attorney, Agent, or Firm* — Osha Bergman Watanabe & Burton LLP

(57) ABSTRACT

A relay has a first fixed contact, a second fixed contact, a movable touch piece including a first movable contact that is disposed facing the first fixed contact, and a second movable contact that is disposed facing the second fixed contact, the movable touch piece being disposed so as to be movable in a direction in which the first movable contact and the second movable contact come into contact with the first fixed contact and the second fixed contact and in a direction in which the first movable contact and the second movable contact separate from the first fixed contact and the second fixed contact, a holder configured to hold the movable touch piece, a drive shaft connected to the holder, and a drive device configured to move the drive shaft in a movement direction of the movable touch piece.

20 Claims, 15 Drawing Sheets

(56) References Cited

U.S. PATENT DOCUMENTS

| | | | | |
|---|---|---|---|---|
| 8,269,585 | B2 * | 9/2012 | Choi | H01H 1/2008 335/126 |
| 8,324,995 | B1 | 12/2012 | Takahama | |
| 9,799,474 | B2 * | 10/2017 | Sakai | H01H 50/58 |
| 2006/0109070 | A1 * | 5/2006 | Hirabayashi | H01H 51/065 335/126 |
| 2009/0322455 | A1 * | 12/2009 | Yoshihara | H01H 50/36 335/189 |
| 2012/0092097 | A1 | 4/2012 | Choi | |
| 2015/0008105 | A1 | 1/2015 | Haenel et al. | |
| 2016/0155592 | A1 | 6/2016 | Ito et al. | |
| 2016/0300676 | A1 | 10/2016 | Sakai et al. | |
| 2017/0011864 | A1 | 1/2017 | Kroeker et al. | |
| 2019/0035586 | A1 | 1/2019 | Ito et al. | |
| 2019/0304724 | A1 * | 10/2019 | Minowa | H01H 1/62 |
| 2019/0304728 | A1 * | 10/2019 | Minowa | H01H 50/58 |

FOREIGN PATENT DOCUMENTS

| | | | |
|---|---|---|---|
| CN | 106057586 | A | 10/2016 |
| CN | 106340408 | A | 1/2017 |
| DE | 102013210211 | A1 | 12/2014 |
| EP | 3002767 | A1 | 4/2016 |
| JP | S4919904 | A | 2/1974 |
| JP | 2005-038706 | A | 2/2005 |
| JP | 2012-048907 | A | 3/2012 |
| JP | 2014157829 | A | 8/2014 |
| JP | 2014157830 | A | 8/2014 |
| JP | 2015-510236 | A | 4/2015 |
| JP | 2016-201286 | A | 12/2016 |
| WO | 2014208098 | A1 | 12/2014 |

OTHER PUBLICATIONS

Office Action issued in Chinese Application No. 201910109745.4, dated May 13, 2021 (29 pages).

Chinese Search Report issued in CN 2019101097454 dated Apr. 29, 2021 (6 pages).

* cited by examiner

CONTACT DEVICE AND RELAY USING THE SAME

CROSS-REFERENCE TO RELATED APPLICATION

This application claims priority to Japanese Patent Application No. 2018-068872 filed with the Japan Patent Office on Mar. 30, 2018, the entire contents of which are incorporated herein by reference.

BACKGROUND

Field

The present invention relates to a relay.

Related Art

A relay is provided with a movable touch piece including a movable contact, and a fixed terminal including a fixed contact. The movable touch piece is held by a holder. The holder is connected to a drive shaft. The drive shaft is driven by a drive device such as a coil. Thereby, the movable touch piece operates and the movable contact comes in contact with or separates from the fixed contact so that the contacts are opened and closed.

For example, in PCT Publication No. 2015-510236, the movable touch piece is held by a plat-shaped holder. When the contacts are separated, the end portion of the holder is pressed against the movable touch piece by an elastic force of an elastic member. When the movable touch piece moves against the elastic force of the elastic member and the movable contact comes into contact with the fixed contact, the end portion of the holder separates from the movable touch piece.

In Japanese Unexamined Patent Publication No. 2016-201286, a movable touch piece is held by a holder and an adjuster. The holder and the adjuster are separate parts formed of different materials, and the adjuster is fixed to the holder. When a movable touch piece moves, the adjuster abuts on the upper surface of the movable touch piece to restrict the movement of the movable contact.

In the structure in which the movable touch piece is brought into contact with the end portion of the holder as disclosed in PCT International Publication No. 2015-510236, when the movable touch piece moves, the movable touch piece comes into contact with the end portion of the holder and is thereby scraped. If the scrape generated by the scraping of the movable touch piece adheres to the contact, contact failure of the contact may occur. Alternatively, if the scrape adheres to the drive shaft, the drive shaft may malfunction.

Meanwhile, if a member different from the holder is used as in Japanese Unexamined Patent Publication No. 2016-201286, an increase in number of parts may lead to an increase in manufacturing cost or a decrease in ease of assembly.

SUMMARY

One or more embodiments of the present invention prevents scraping of a movable touch piece by a holder while preventing an increase in manufacturing cost and a decrease in ease of assembly.

A relay according to one or more embodiments of the present invention includes a first fixed contact, a second fixed contact, a movable contact piece, a holder, a drive shaft, and a drive device. The movable touch piece includes a first movable contact and a second movable contact. The first movable contact is disposed facing the first fixed contact. The second movable contact is disposed facing the second fixed contact. The movable touch piece is disposed so as to be movable in a direction in which the first movable contact and the second movable contact come into contact with the first fixed contact and the second fixed contact and in a direction in which the first movable contact and the second movable contact separate from the first fixed contact and the second fixed contact. The holder holds the movable touch piece. The drive shaft is connected to the holder. The drive device moves the drive shaft in the movement direction of the movable touch piece. The holder includes a pressing surface integrally formed in the holder. The pressing surface has a flat shape along the surface of the movable touch piece and comes into surface contact with the movable touch piece to press the movable touch piece.

In the relay according to the present aspect, the pressing surface of the holder comes into surface contact with the movable touch piece to press the movable touch piece. Since the pressing surface has a flat shape along the surface of the movable touch piece, scraping of the movable touch piece when coming into contact with the movable touch piece is prevented. In addition, since the pressing surface is integrally formed in the holder, it is possible to prevent an increase in manufacturing cost and a decrease in ease of assembly.

The pressing surface may be formed by bending a part of the holder. In this instance, the pressing surface can be formed easily.

The holder may further include a base and a side surface. The base may be disposed facing the movable touch piece. The side surface may extend from the base toward the movable touch piece. The holder may have a shape bent between the pressing surface and the side surface. In this instance, it is possible to easily form the pressing surface by bending a part of the side surface.

The side surface may be disposed facing the side edge of the movable touch piece extending in the longitudinal direction of the movable touch piece. The pressing surface may extend in a lateral direction of the movable touch piece from the side surface. In this instance, the movable touch piece can be held by the pressing surface extending in the lateral direction.

The side surface may include an opening through which the movable touch piece is allowed to pass. The pressing surface may extend in the longitudinal direction of the movable touch piece from the side surface. In this instance, the movable touch piece can be held by the pressing surface extending in the longitudinal direction.

The pressing surface may be disposed over the lateral direction of the movable touch piece from the side surface. In this instance, a wide range of the movable touch piece can be held by the pressing surface.

The pressing surface may be formed by bending a part of the side surface. In this instance, the pressing surface can be formed easily.

The holder may further include a base, a first side surface, and a second side surface. The base may be disposed facing the movable touch piece. The first side surface may extend from the base toward the movable touch piece. The second side surface may be spaced from the first side surface and extend from the base toward the movable touch piece. The pressing surface may include a first pressing surface and a second pressing surface. The first pressing surface may extend from the first side surface along the surface of the movable touch piece. The second pressing surface may extend along the surface of the movable touch piece from the second side surface. In this instance, the movable touch piece can be stably held by the first pressing surface and the second pressing surface.

The first side surface may be disposed facing one side edge of the movable touch piece extending in the longitudinal direction of the movable touch piece. The second side surface may be disposed facing the other side edge of the movable touch piece extending in the longitudinal direction of the movable touch piece. The first pressing surface may extend in the lateral direction of the movable touch piece from the first side surface. The second pressing surface may extend in the lateral direction of the movable touch piece from the second side surface. In this instance, the movable touch piece can be stably held by the first pressing surface and the second pressing surface extending in the lateral direction.

The first side surface may include a first opening through which the movable touch piece is allowed to pass. The second side surface may be spaced from the first side surface in the longitudinal direction of the movable touch piece. The second side surface may include a second opening through which the movable touch piece is allowed to pass. The first pressing surface may extend in the longitudinal direction of the movable touch piece from the first side surface. The second pressing surface may extend in the longitudinal direction of the movable touch piece from the second side surface. In this instance, the movable touch piece can be stably held by the first pressing surface and the second pressing surface extending in the longitudinal direction.

A recessed groove may be provided on the surface of the movable touch piece. The holder may include a protrusion protruding from the pressing surface toward the inside of the recessed groove. In this instance, by the protrusion coming into contact with the recessed groove, the holder can be made to hardly come off the movable touch piece.

The tip of the protrusion may be disposed away from the bottom of the recessed groove. In this instance, it is possible to prevent scraping of the movable touch piece by the tip of the protrusion.

According to one or more embodiments of the present invention, it is possible to prevent scraping of a movable touch piece by a holder while preventing an increase in manufacturing cost and a decrease in ease of assembly.

DETAILED DESCRIPTION

Figure 1:
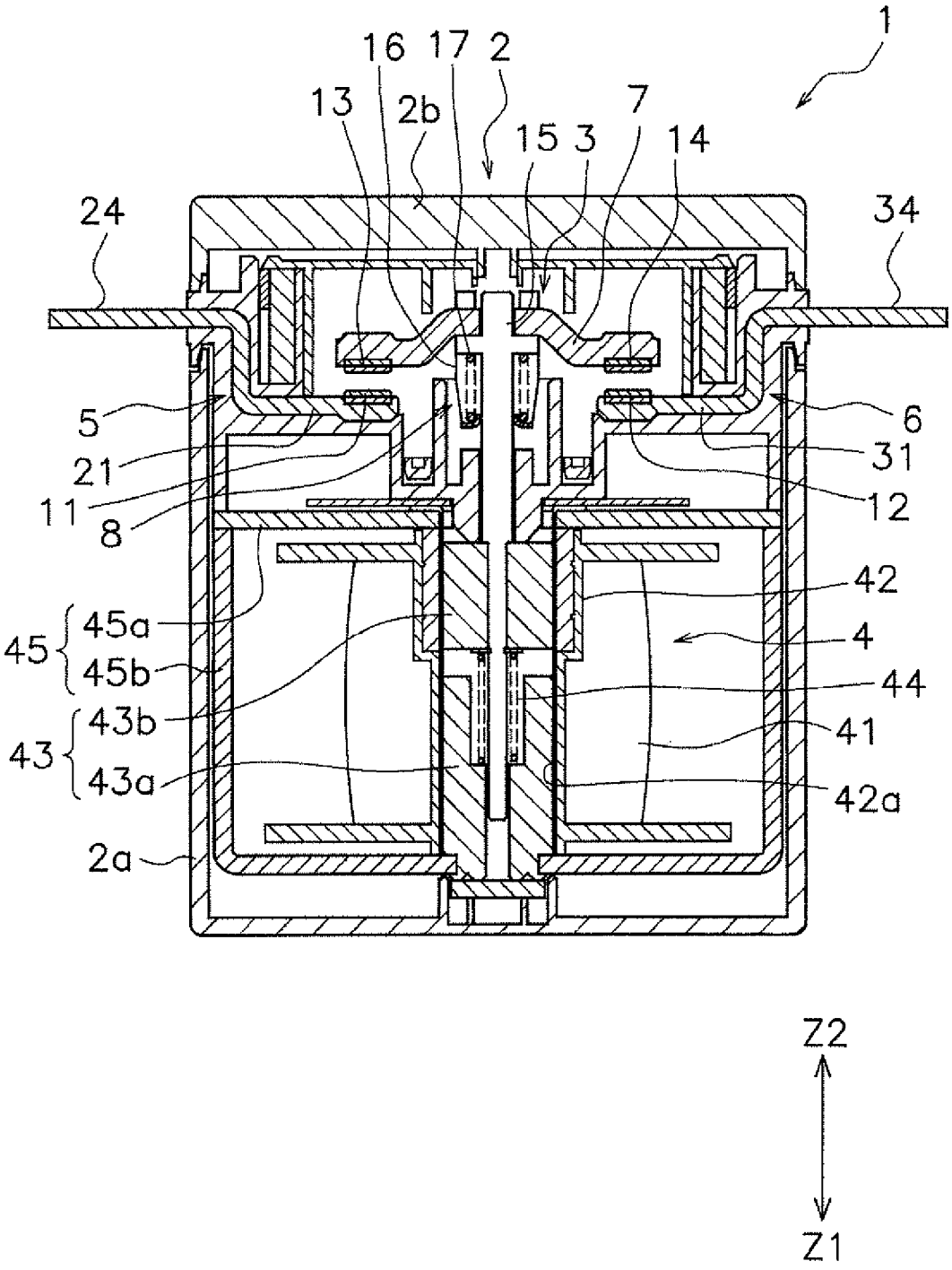
FIG. 1 is a sectional view of a relay according to one or more embodiments of the present invention.

Hereinafter, embodiments of the present invention will be described with reference to the drawings. In embodiments of the invention, numerous specific details are set forth in order to provide a more thorough understanding of the invention. However, it will be apparent to one of ordinary skill in the art that the invention may be practiced without these specific details. In other instances, well-known features have not been described in detail to avoid obscuring the invention. FIG. 1 is a sectional view illustrating the relay 1 according to one or more embodiments of the present invention. As illustrated in FIG. 1, the relay 1 includes a case 2, a contact device 3, and a drive device 4.

The case 2 accommodates the contact device 3 and the drive device 4. The case 2 is formed of a resin having insulation. The case 2 includes a case body 2*a* and a lid portion 2*b*. The contact device 3 and the drive device 4 are disposed in the case body 2*a*. The lid portion 2*b* is separate from the case body 2*a*. The lid portion 2*b* is attached to the case body 2*a*.

The contact device 3 includes a first fixed terminal 5, a second fixed terminal 6, a movable touch piece 7, and a touch piece holding portion 8. The first fixed terminal 5, the second fixed terminal 6, and the movable touch piece 7 are formed of a material having conductivity. The first fixed terminal 5 includes a first fixed contact 11. The second fixed terminal 6 includes a second fixed contact 12. The first fixed contact 11 and the second fixed contact 12 are disposed apart from each other in a longitudinal direction of the movable touch piece 7 (a right-left direction in FIG. 3).

The movable touch piece 7 includes a first movable contact 13 and a second movable contact 14. The first movable contact 13 is disposed facing the first fixed contact 11. The second movable contact 14 is disposed facing the second fixed contact 12. The movable touch piece 7 is disposed movably in a contact direction Z1 and a separation direction Z2.

The contact direction Z1 is a direction (downward in FIG. 1) in which the first movable contact 13 and the second movable contact 14 come into contact with the first fixed contact 11 and the second fixed contact 12. The separation direction Z2 is a direction (upward in FIG. 1) in which the first movable contact 13 and the second movable contact 14 separate from the first fixed contact 11 and the second fixed contact 12.

The touch piece holding portion 8 holds the movable touch piece 7. The touch piece holding portion 8 includes a drive shaft 15, a holder 16, and a contact spring 17. The drive shaft 15 extends in a movement direction (Z1, Z2) of the movable touch piece 7. The drive shaft 15 is disposed movably in the contact direction Z1 and the separation direction Z2. The holder 16 is connected to the movable touch piece 7 and holds the movable touch piece 7. The contact spring 17 is disposed between the drive shaft 15 and the holder 16. The drive shaft 15 is connected to the holder 16 via a contact spring 17. The structure of the touch piece holding portion 8 will be described later in detail.

The first fixed terminal 5 includes a first contact support 21 and a first external connection 24. The first contact support 21 supports the first fixed contact 11 in the case 2. The first external connection 24 is connected to the first contact support 21. The first external connection 24 protrudes outward of the case 2. The first external connection 24 may be formed integrally with the first contact support 21. Alternatively, the first external connection 24 may be separate from the first contact support 21.

The second fixed terminal 6 includes a second contact support 31 and a second external connection 34. The second contact support 31 supports the second fixed contact 12 inside the case 2. The second external connection 34 is connected to the second contact support 31. The second external connection 34 protrudes outward of the case 2. The second external connection 34 may be formed integrally with the second contact support 31. Alternatively, the second external connection 34 may be separate from the second contact support 31.

The drive device 4 generates a driving force for operating the movable touch piece 7. The drive device 4 operates the movable touch piece 7 by an electromagnetic force. The drive device 4 is disposed in the movement direction (Z1, Z2) of the movable touch piece 7 with respect to the movable touch piece 7. The drive device 4 includes a coil 41, a spool 42, a core 43, a return spring 44, and a yoke 45.

The coil 41 is wound around the spool 42. The coil 41 and the spool 42 are disposed coaxially with the drive shaft 15. The spool 42 includes a hole 42*a* penetrating in an axial direction of the spool 42. The iron core 43 and the return spring 44 are inserted into a hole 42*a* of the spool 42. The yoke 45 is connected to the iron core 43.

The yoke 45 includes a first yoke 45*a* and a second yoke 45*b*. The first yoke 45*a* is disposed between the contact device 3 and the spool 42. The second yoke 45*b* is connected to the first yoke 45*a*. The second yoke 45*b* includes a U-shape. The second yoke 45*b* is disposed on each side of the coil 41 and on the side opposite to the first yoke 45*a* with respect to the coil 41. The first yoke 45*a* is connected to one end of the iron core 43. The second yoke 45*b* is connected to the other end of the iron core 43.

The iron core 43 includes a fixed iron core 43*a* and a movable iron core 43*b*. The fixed iron core 43*a* is fixed to the second yoke 45*b*. The movable iron core 43*b* is separate from the fixed iron core 43*a*. The movable iron core 43*b* is disposed movably in the contact direction Z1 and the separation direction Z2. The movable iron core 43*b* is connected to the drive shaft 15. The return spring 44 is disposed between the movable iron core 43*b* and the fixed iron core 43*a*. The return spring 44 urges the movable iron core 43*b* in the separation direction Z2.

Figure 2:
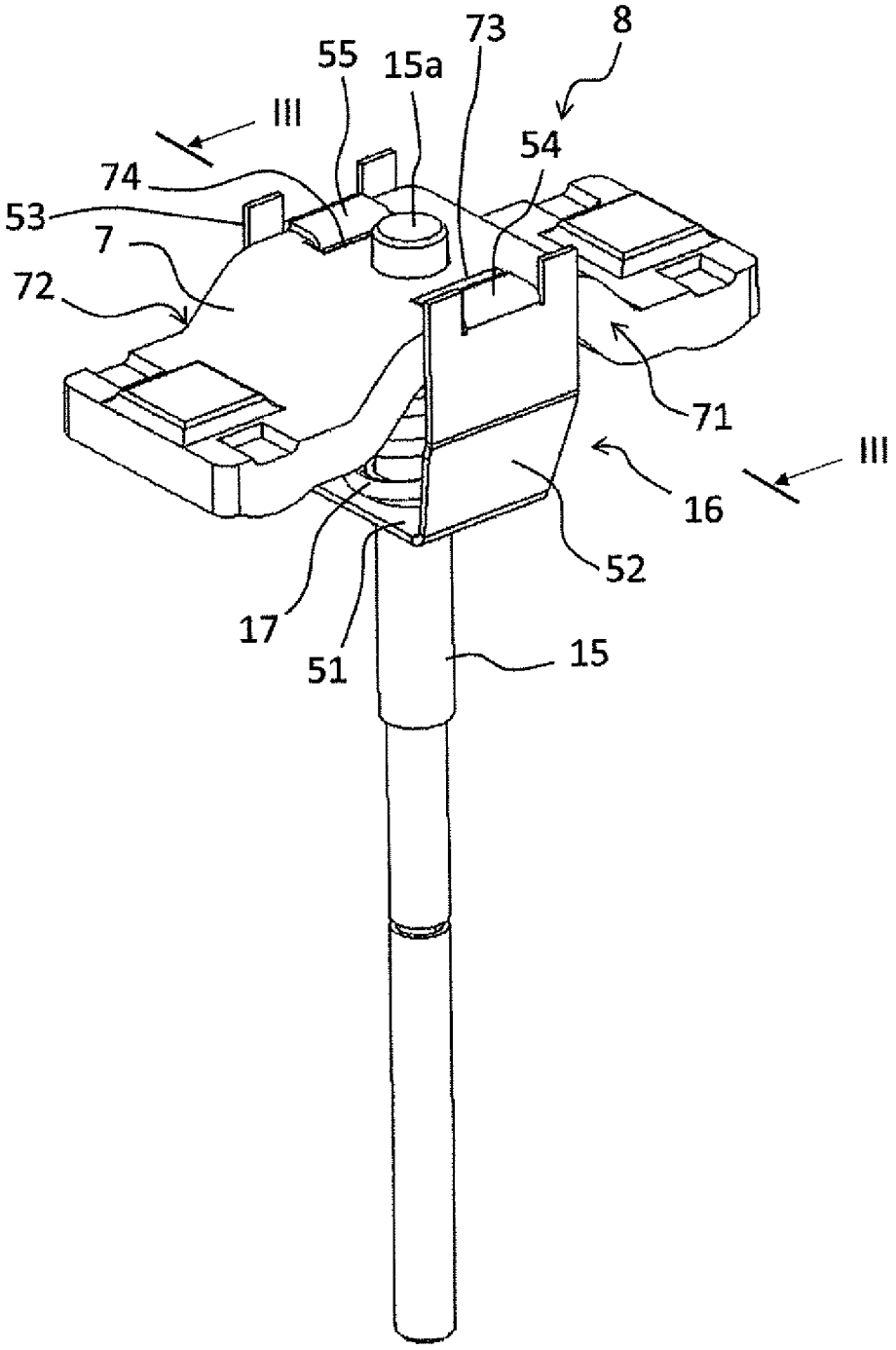
FIG. 2 is a perspective view of a touch piece holding portion.
Figure 3:
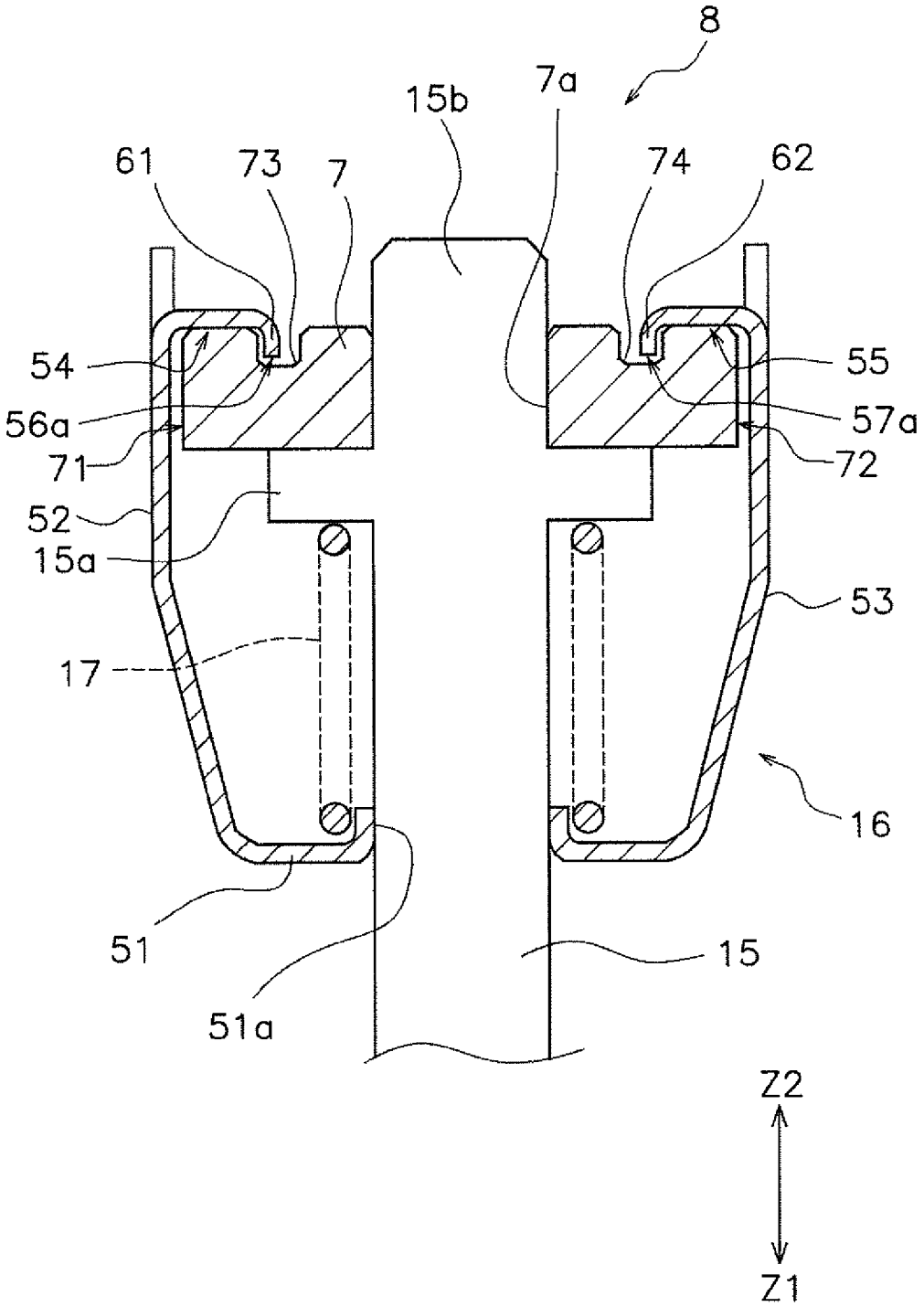
FIG. 3 is a sectional view of the touch piece holding portion.

Next, the touch piece holding portion 8 will be described in detail. FIG. 2 is a perspective view of the touch piece holding portion 8. FIG. 3 is a sectional view taken along a line III-Ill in FIG. 2. As illustrated in FIG. 3, the drive shaft 15 includes a flange portion 15*a* protruding in the radial direction. The flange portion 15*a* is disposed in the contact direction Z1 with respect to the movable touch piece 7. The drive shaft 15 includes a guide shaft portion 15*b* protruding in the separation direction Z2 from the flange portion 15*a*. The guide shaft portion 15*b* is inserted into a hole 7*a* provided in the movable touch piece 7. The guide shaft portion 15*b* is disposed so as to be movable in the axial direction of the drive shaft 15 with respect to the movable touch piece 7.

The holder 16 includes a base 51, a first side surface 52, a second side surface 53, a first pressing surface 54, and a second pressing surface 55. The base 51 is disposed facing the movable touch piece 7. The base 51 is provided with a hole 51*a* through which the drive shaft 15 is allowed to pass. The flange portion 15*a* is disposed between the movable touch piece 7 and the base 51 in the movement direction (Z1, Z2) of the movable touch piece 7. The contact spring 17 is disposed between the flange portion 15*a* and the base 51.

The first side surface 52 and the second side surface 53 extend from the base 51 toward the movable touch piece 7. The first side surface 52 and the second side surface 53 are spaced from each other in the lateral direction of the movable touch piece 7. A part of the drive shaft 15 and the contact spring 17 are disposed between the first side surface 52 and the second side surface 53. The first side surface 52 is disposed facing one side edge 71 of the movable touch piece 7 extending in the longitudinal direction of the movable touch piece 7. The second side surface 53 is disposed facing the other side edge 72 of the movable touch piece 7 extending in the longitudinal direction of the movable touch piece 7. The first pressing surface 54 and the second pressing surface 55 are integrally formed in the holder 16. The first pressing surface 54 and the second pressing surface 55 are each formed by folding a part of the holder 16. Specifically, the first pressing surface 54 is formed by bending a part of the first side surface 52. The first pressing surface 54 extends in the lateral direction of the movable touch piece 7 from the first side surface 52. The second pressing surface 55 is formed by bending a part of the second side surface 53. The second pressing surface 55 extends in the lateral direction of the movable touch piece 7 from the second side surface 53.

The first pressing surface 54 and the second pressing surface 55 are spaced from each other in the lateral direction of the movable touch piece 7. The first pressing surface 54 extends from the first side surface 52 along the surface of the movable touch piece 7. The second pressing surface 55 extends along the surface of the movable touch piece 7 from the second side surface 53. The first pressing surface 54 and the second pressing surface 55 each have a flat shape along the surface of the movable touch piece 7. The first pressing surface 54 and the second pressing surface 55 come into surface contact with the movable touch piece 7 to press the movable touch piece 7.

The holder 16 has a shape bent between the first side surface 52 and the base 51. The holder 16 has a shape bent between the first side surface 52 and the first pressing surface 54. The holder 16 has a shape bent between the second side surface 53 and the base 51. The holder 16 has a shape bent between the second side surface 53 and the second pressing surface 55.

As illustrated in FIG. 3, a first recessed groove 73 and a second recessed groove 74 are provided on the surface of the movable touch piece 7. The first recessed groove 73 and the second recessed groove 74 are spaced from each other in the lateral direction of the movable touch piece 7. The first recessed groove 73 and the second recessed groove 74 extend in the longitudinal direction of the movable touch piece 7. The first recessed groove 73 and the second recessed groove 74 each have a shape recessed in the contact direction Z1 from one surface of the movable touch piece 7.

The holder 16 further includes a first protrusion 61 and a second protrusion 62. The first protrusion 61 protrudes from the first pressing surface 54 toward the inside of the first recessed groove 73. The holder 16 has a shape bent between the first pressing surface 54 and the first protrusion 61. The second protrusion 62 protrudes from the second pressing surface 55 toward the inside of the second recessed groove 74. The holder 16 has a shape bent between the second pressing surface 55 and the second protrusion 62.

In the holder 16, the base 51, the first side surface 52, the second side surface 53, the first pressing surface 54, the second pressing surface 55, the first protrusion 61, and the second protrusion 62 are formed integrally. However, some of these parts may be formed separately.

Figure 4:
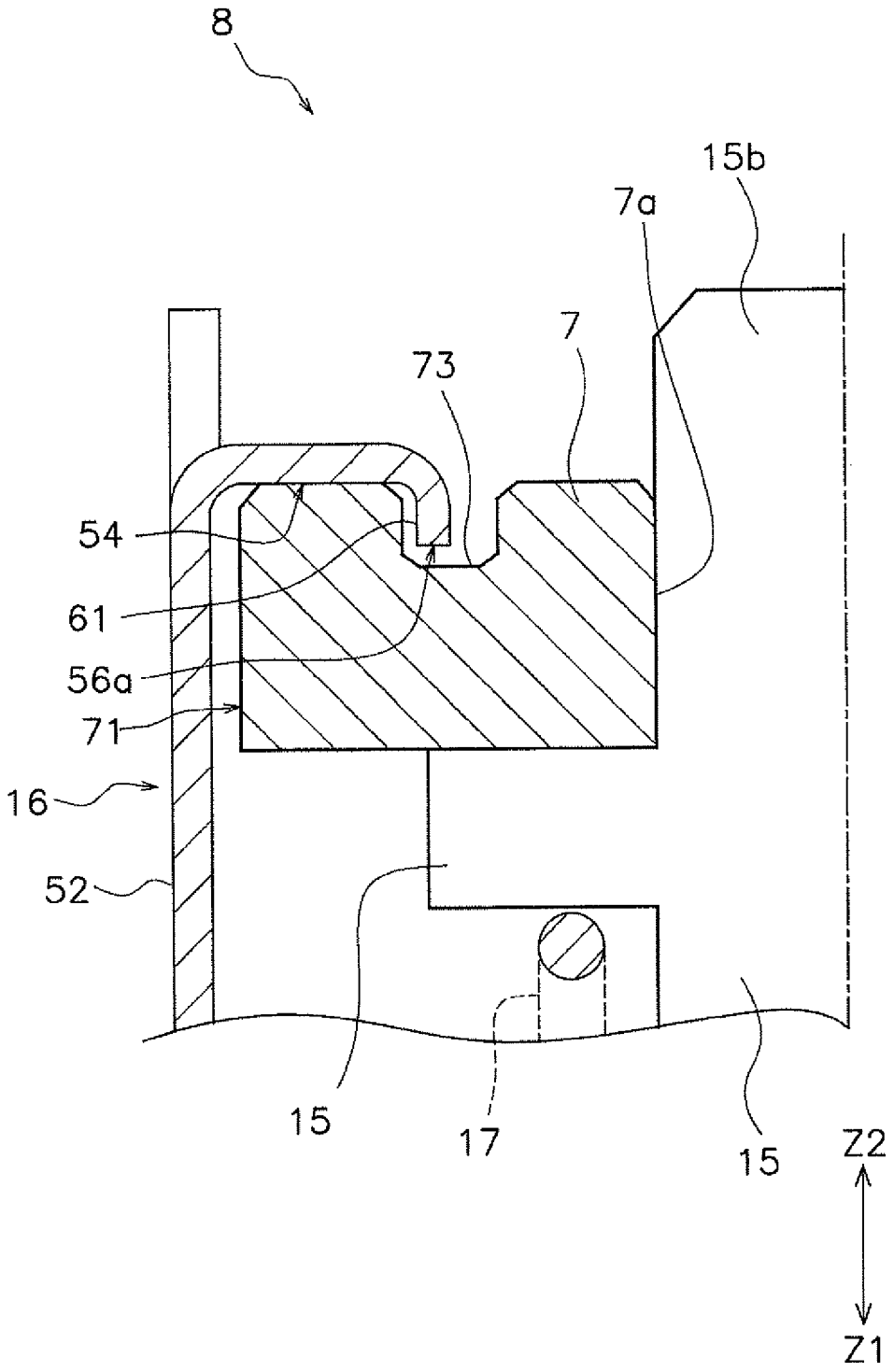
FIG. 4 is an enlarged sectional view of the touch piece holding portion.

FIG. 4 is an enlarged sectional view of the first protrusion 61 and the first recessed groove 73. As illustrated in FIG. 4, a tip 56*a* of the first protrusion 61 is disposed away from the bottom of the first recessed groove 73. Similarly to the first protrusion 61, a tip 57*a* of the second protrusion 62 is also disposed away from the bottom of the second recessed groove 74.

Figure 5A:
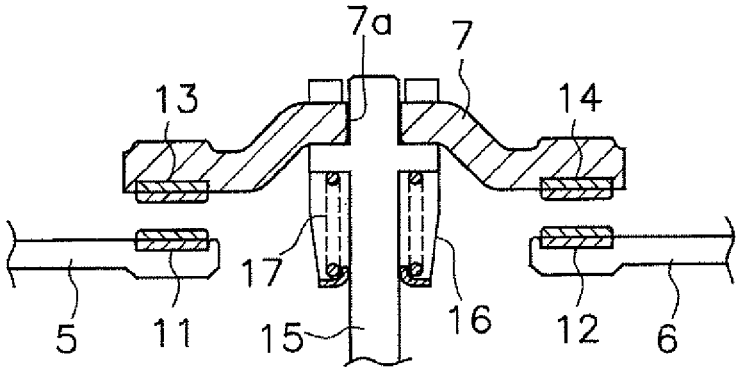
FIGS. 5A to 5C are diagrams illustrating opening and closing operations of contacts.

Next, the operation of the relay 1 will be described. When no voltage is applied to the coil 41, the drive shaft 15 is pressed, together with the movable iron core 43*b*, in the separation direction Z2 by an elastic force of the return spring 44. Therefore, the movable touch piece 7 is also pressed in the separation direction Z2, and as illustrated in FIG. 5A, the first movable contact 13 and the second movable contact 14 are in an open state, being separated from the first fixed contact 11 and the second fixed contact 12.

Note that the contact spring 17 is disposed between the flange portion 15*a* and the base 51 in a pre-compressed state. Therefore, in the open state illustrated in FIG. 5A, the contact spring 17 urges the holder 16 and the flange portion 15*a* in a direction sandwiching the movable touch piece 7. The first pressing surface 54 and the second pressing surface 55 of the holder 16 are thus kept in contact with the movable touch piece 7.

Figure 5B:
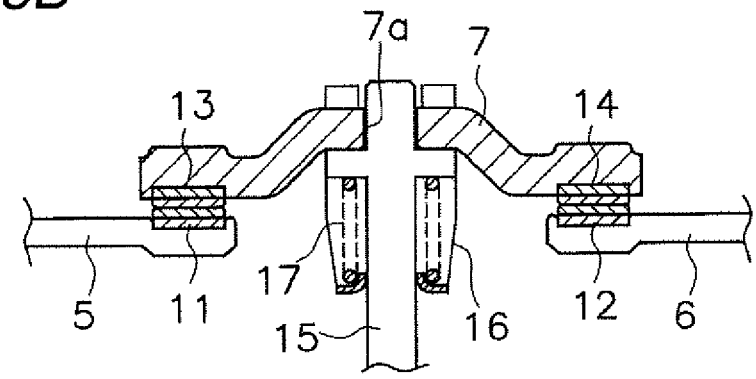

When a voltage is applied to the coil 41 and excited, by an electromagnetic force of the coil 41, the movable iron core 43*b* moves in the contact direction Z1 against the elastic force of the return spring 44. Thus, as illustrated in FIG. 5B, the drive shaft 15, the holder 16, and the movable touch piece 7 move together in the contact direction Z1, and the first movable contact 13 and the second movable contact 14 come into contact with the first fixed contact 11 and the second fixed contact 12.

Figure 5C:
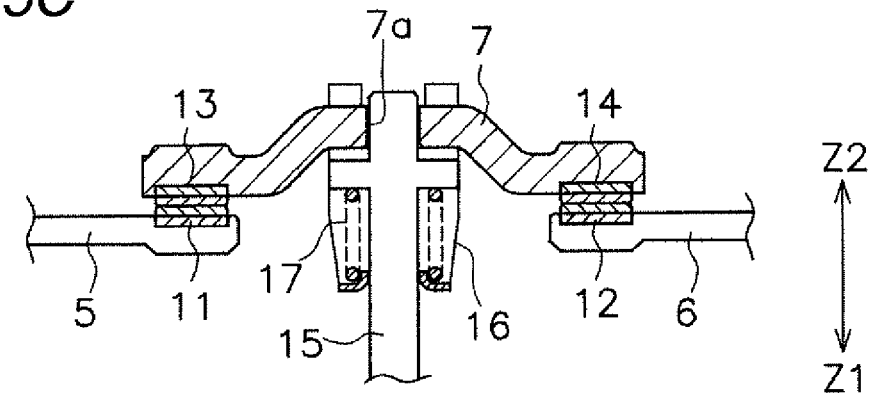

In this state, the movement of the movable touch piece 7 and the holder 16 in the contact direction Z1 is restricted by the first fixed terminal 5 and the second fixed terminal 6, but the drive shaft 15 is movable with respect to the movable touch piece 7. Therefore, when the movable iron core 43*b* further moves in the contact direction Z1 by the electromagnetic force of the coil 41, the drive shaft 15 further moves in the contact direction Z1. As a result, as illustrated in FIG. 5C, the contact spring 17 contracts due to being pushed by the flange portion 15*a*. In this state, the contact spring 17 urges the holder 16 in the contact direction Z1 by the elastic force. Then, the first pressing surface 54 and the second pressing surface 55 of the holder 16 come into contact with the movable touch piece 7 and press the movable touch piece 7 in the contact direction Z1.

In the relay 1 according to one or more embodiments, the first pressing surface 54 and the second pressing surface 55 of the holder 16 come into surface contact with the movable touch piece 7 to press the movable touch piece 7. Since the first pressing surface 54 and the second pressing surface 55 each have a flat shape along the surface of the movable touch piece 7, scraping of the movable touch piece 7 when coming into contact with the movable touch piece 7 is prevented. In addition, since the first pressing surface 54 and the second pressing surface 55 are integrally formed in the holder 16, it is possible to prevent an increase in manufacturing cost and a decrease in ease of assembly.

The first pressing surface 54 and the second pressing surface 55 are each formed by folding a part of the holder 16. Therefore, it is possible to easily form the first pressing surface 54 and the second pressing surface 55.

The first protrusion 61 of the holder 16 protrudes toward the inside of the first recessed groove 73 of the movable touch piece 7. Further, the second protrusion 62 of the holder 16 protrudes toward the inside of the second recessed groove 74 of the movable touch piece 7. It is thus possible to prevent the holder 16 from being opened and detached from the movable touch piece 7.

The tip 56*a* of the first protrusion 61 is disposed away from the bottom of the first recessed groove 73. The tip 57*a* of the second protrusion 62 is disposed away from the bottom of the second recessed groove 74. Hence it is possible to prevent the movable touch piece 7 from being scraped by the tip 56*a* of the first protrusion 61 and the tip 57*a* of the second protrusion 62.

Although embodiments of the present invention are described above, the present invention is not limited to the above embodiments, and various changes can be made in the scope not deviating from the gist of the present invention. For example, the configuration of the drive device 4 may be changed. The shape or placement of the coil 41, the spool 42, the iron core 43, the return spring 44, or the yoke 45 may be changed. The shape or placement of the case 2 may be changed.

In one or more of the above embodiments, the drive device 4 draws the drive shaft 15 to the coil 41 side, whereby the movable touch piece 7 moves in the contact direction Z1. In addition, the drive device 4 pushes the drive shaft 15 from the coil 41 side, whereby the movable touch piece 7 moves in the separation direction Z2. However, as the drive device 4 pulls the drive shaft 15 toward the coil 41 side, the movable touch piece 7 may move in the separation direction Z2. The movable touch piece 7 may be moved in the contact direction Z1 by the drive device 4 pushing the drive shaft 15 from the coil 41 side.

The shape or placement of the first fixed terminal 5, the second fixed terminal 6, and the movable touch piece 7 may be changed. For example, the placement of the first fixed terminal 5 and the second fixed terminal 6 is not limited to that of the embodiments described above, and may be interchanged.

Figure 6:
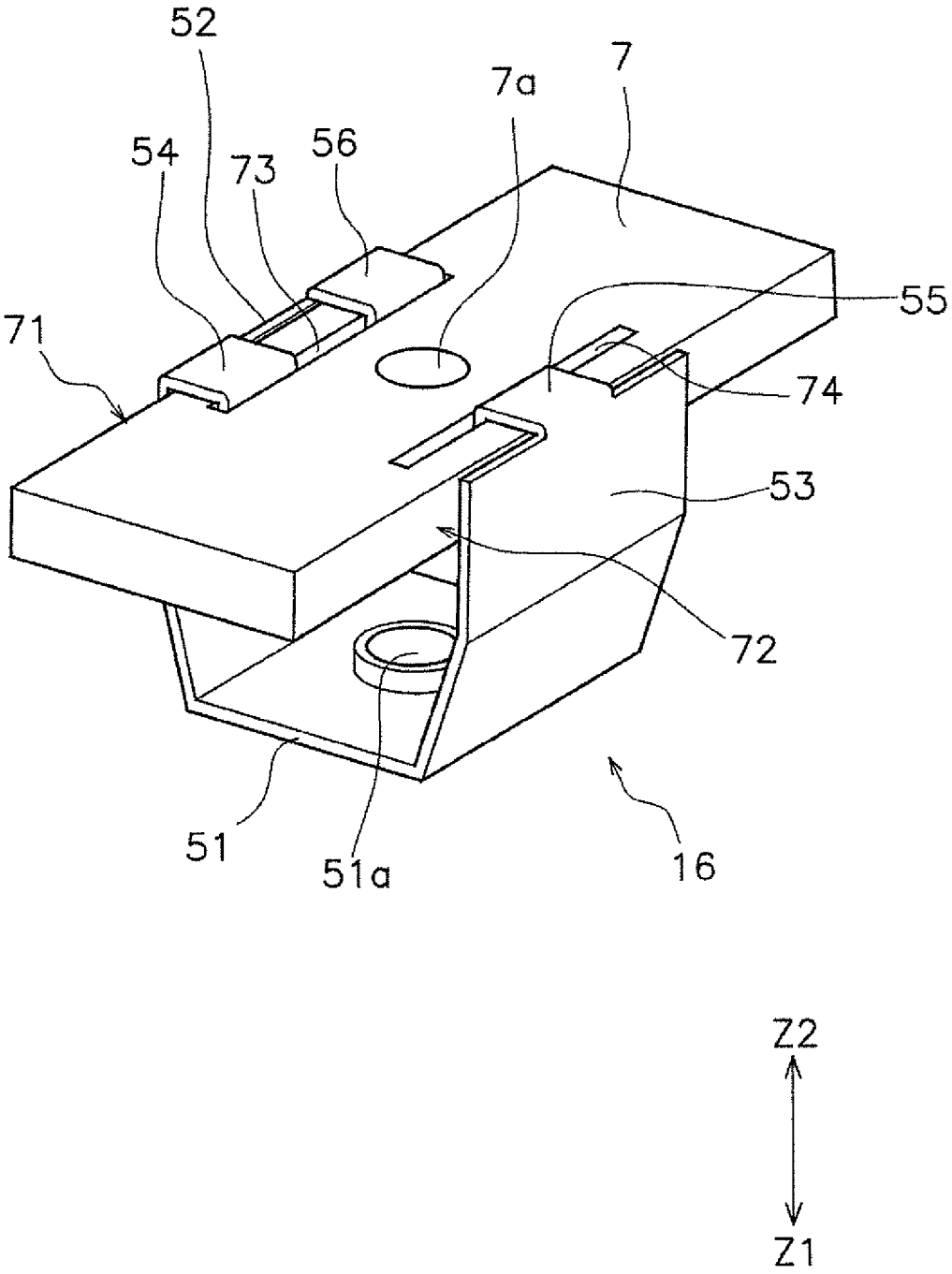
FIG. 6 is a perspective view illustrating a holder according to a first modified example.
Figure 7:
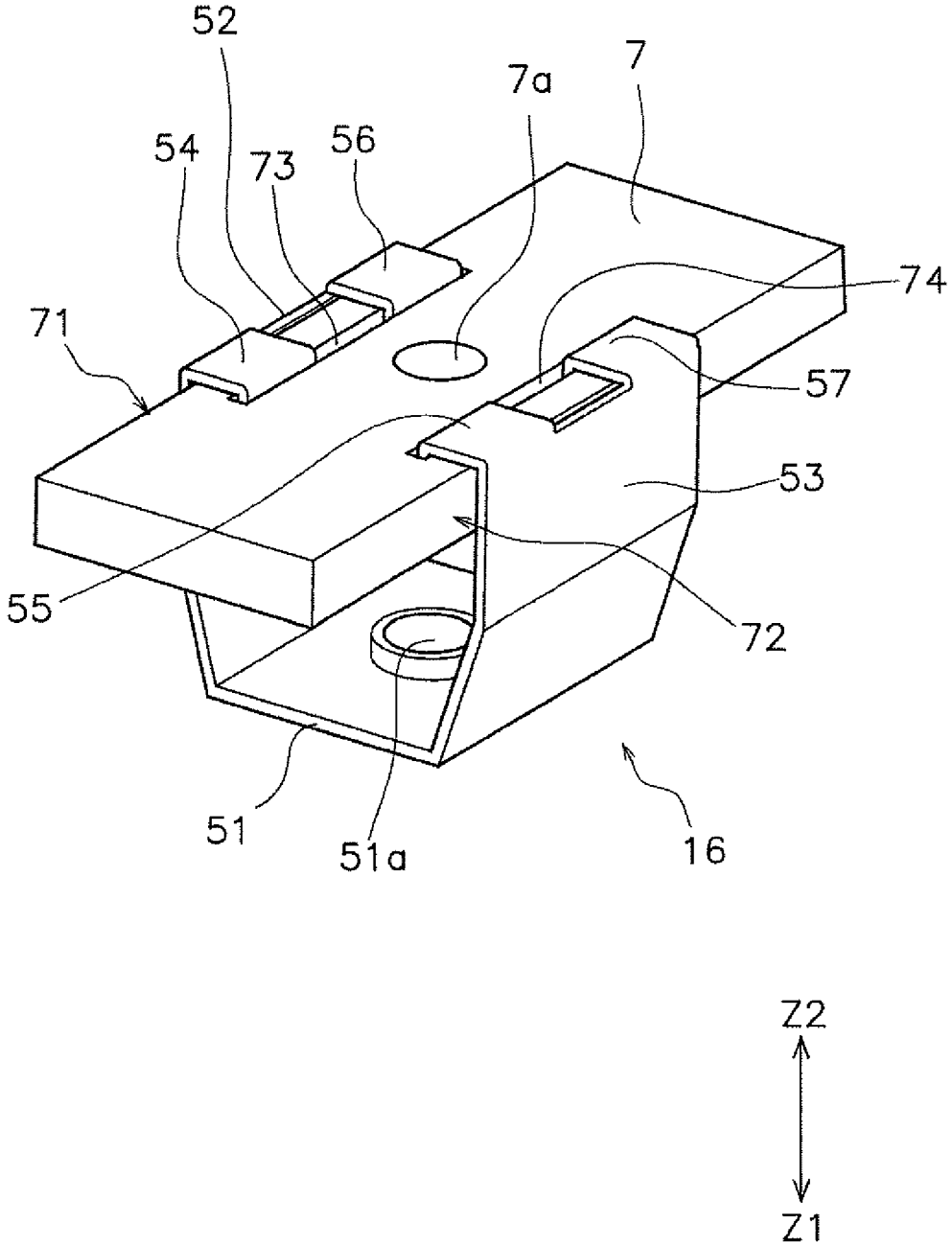
FIG. 7 is a perspective view illustrating a holder according to a second modified example.

The shape of the holder 16 is not limited to that of the above embodiments, and may be changed. For example, in one or the above embodiments, the number of pressing surfaces is two. However, the number of pressing surfaces is not limited to two, and may be one, or three or more. FIG. 6 is a perspective view of the holder 16 according to the first modified example. As illustrated in FIG. 6, the holder 16 may include three pressing surfaces 54-56. Alternatively, FIG. 7 is a perspective view of the holder 16 according to a second modified example. As illustrated in FIG. 7, the holder 16 may include four pressing surfaces 54-57.

Figure 8:
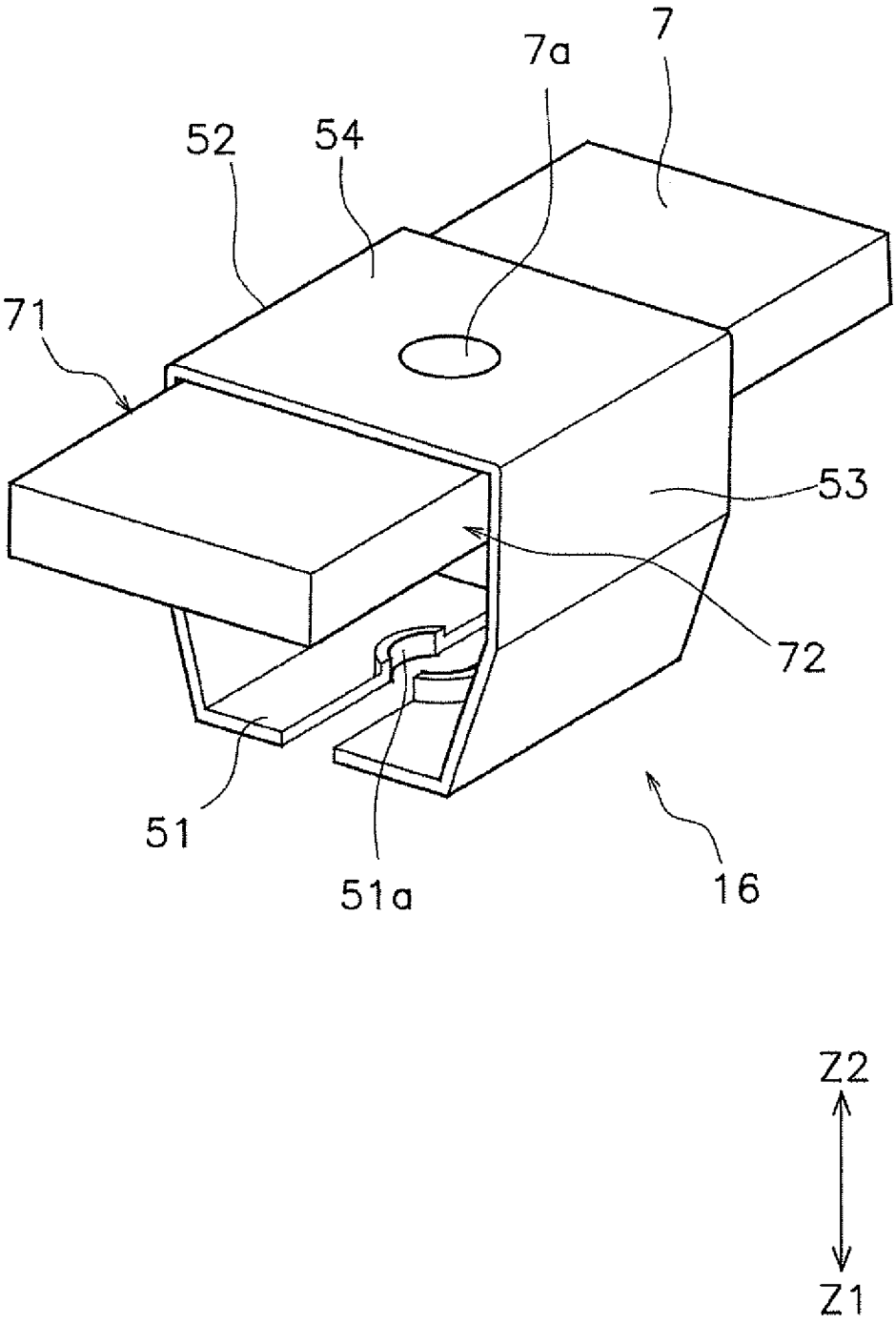
FIG. 8 is a perspective view illustrating a holder according to a third modified example.

FIG. 8 is a perspective view of the holder 16 according to a third modified example. As illustrated in FIG. 8, the holder 16 may include a pressing surface 54 that is disposed over the entire lateral direction of the movable touch piece 7. In this instance, the pressing surface 54 may be connected to the first side surface 52 and the second side surface 53.

Figure 9:
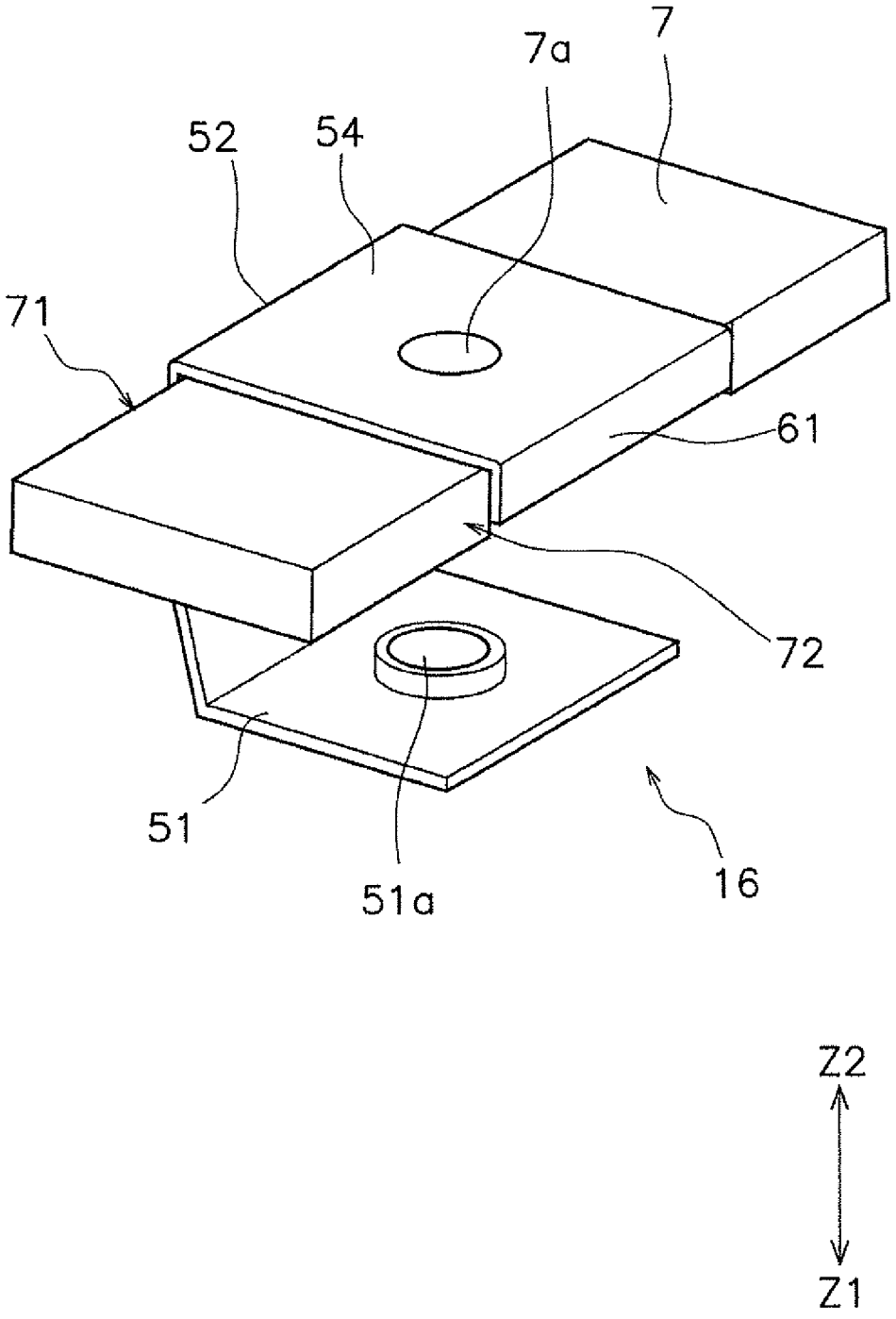
FIG. 9 is a perspective view illustrating a holder according to a fourth modified example.

Alternatively, as in the fourth modified example illustrated in FIG. 9, the pressing surface 54 may be disposed over the entire lateral direction of the movable touch piece 7 and may be connected only to the first side surface 52. In this instance, the second side surface 53 may be omitted. As illustrated in FIG. 9, in the fourth modified example, the holder 16 may include the protrusion 61 protruding so as to face the side edge 72 of the movable touch piece 7. Even with such protrusion 61, it is possible to prevent the holder 16 from being detached from the movable touch piece 7.

Figure 10:
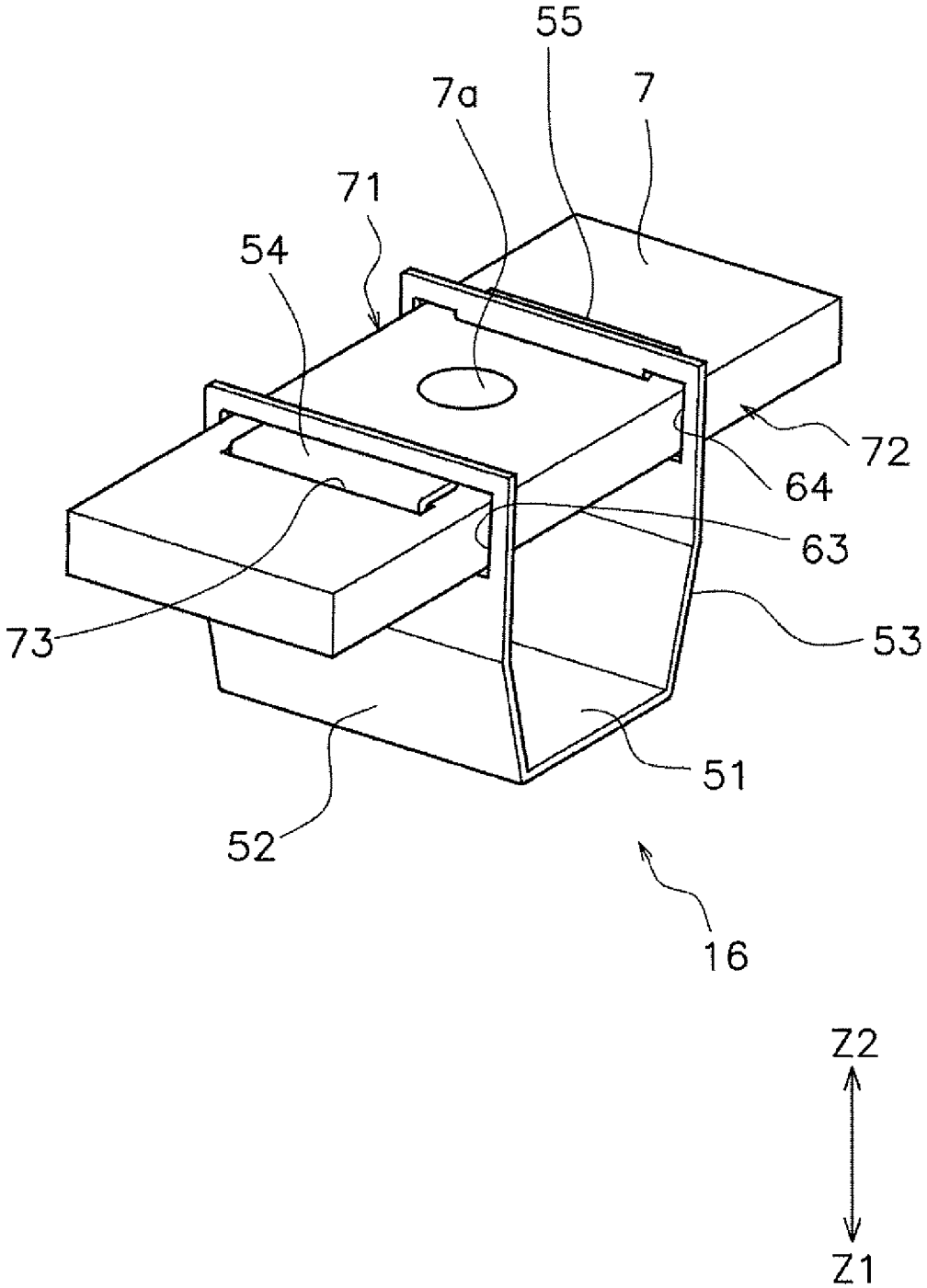
FIG. 10 is a perspective view illustrating a holder according to a fifth modified example.
Figure 11:
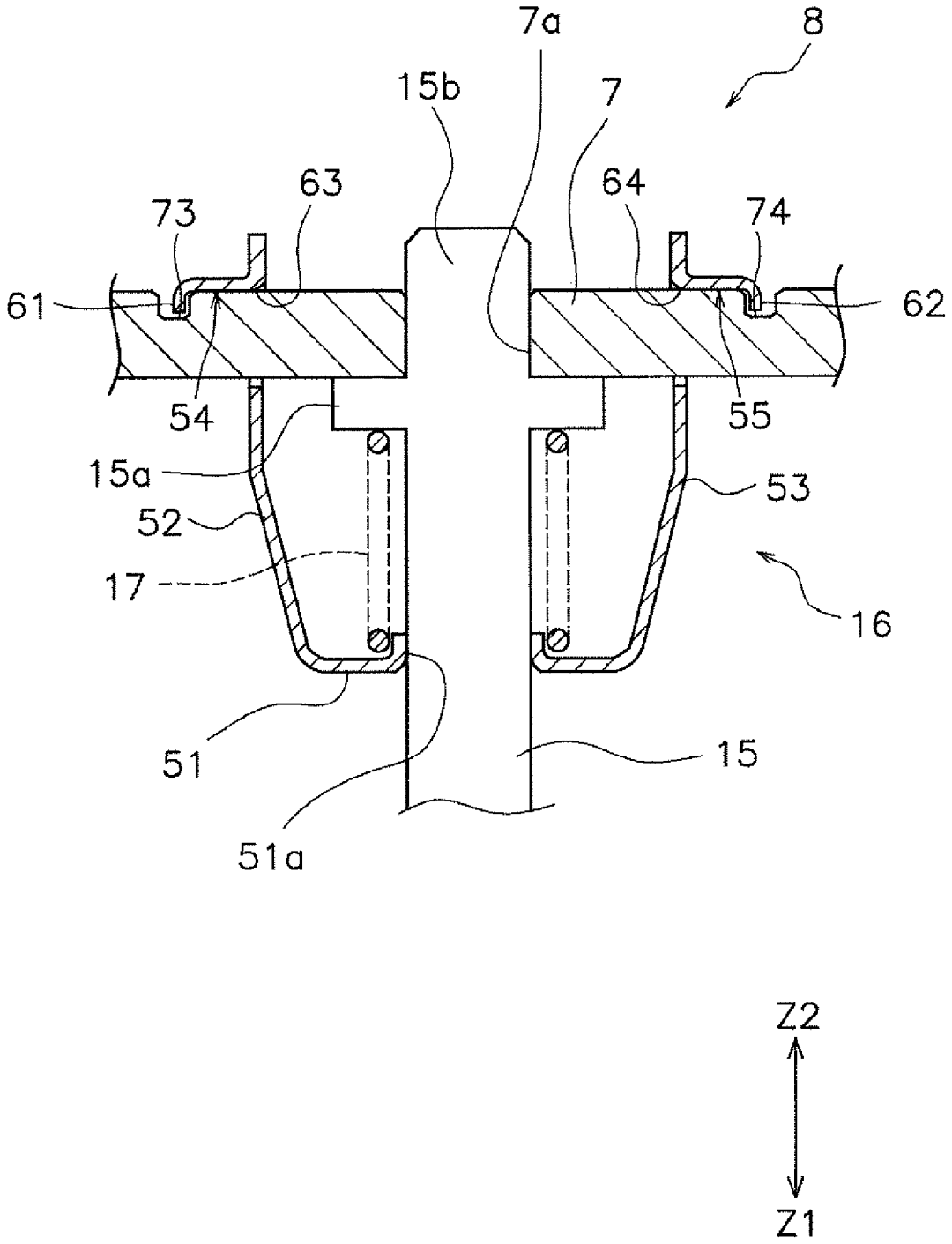
FIG. 11 is a sectional view illustrating the holder according to the fifth modified example.

FIG. 10 is a perspective view of the holder 16 according to a fifth modified example. FIG. 11 is a sectional view of the holder 16 according to the fifth modified example. As illustrated in FIGS. 10 and 11, the first side surface 52 and the second side surface 53 may be spaced from each other in the longitudinal direction of the movable touch piece 7. The first side surface 52 may include a first opening 63 through which the movable touch piece 7 is allowed to pass. The second side surface 53 may include a second opening 64 through which the movable touch piece 7 is allowed to pass. The first pressing surface 54 may extend in the longitudinal direction of the movable touch piece 7 from the first side surface 52. The second pressing surface 55 may extend in the longitudinal direction of the movable touch piece 7 from the second side surface 53. Specifically, the first pressing surface 54 may extend outward in the longitudinal direction of the movable touch piece 7 from the first side surface 52. The second pressing surface 55 may extend outward in the longitudinal direction of the movable touch piece 7 from the second side surface 53.

Figure 12:
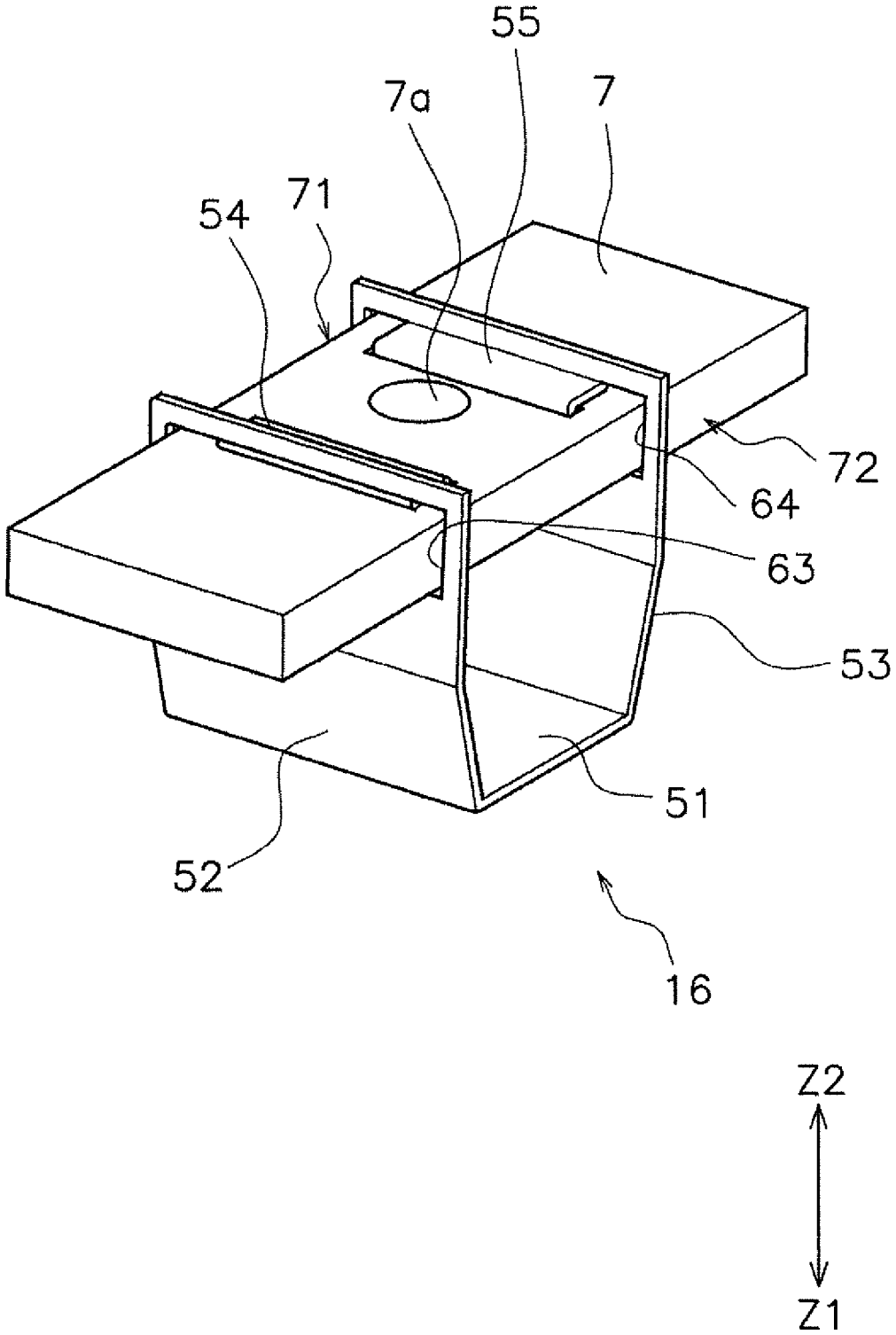
FIG. 12 is a perspective view illustrating a holder according to a sixth modified example.
Figure 13:
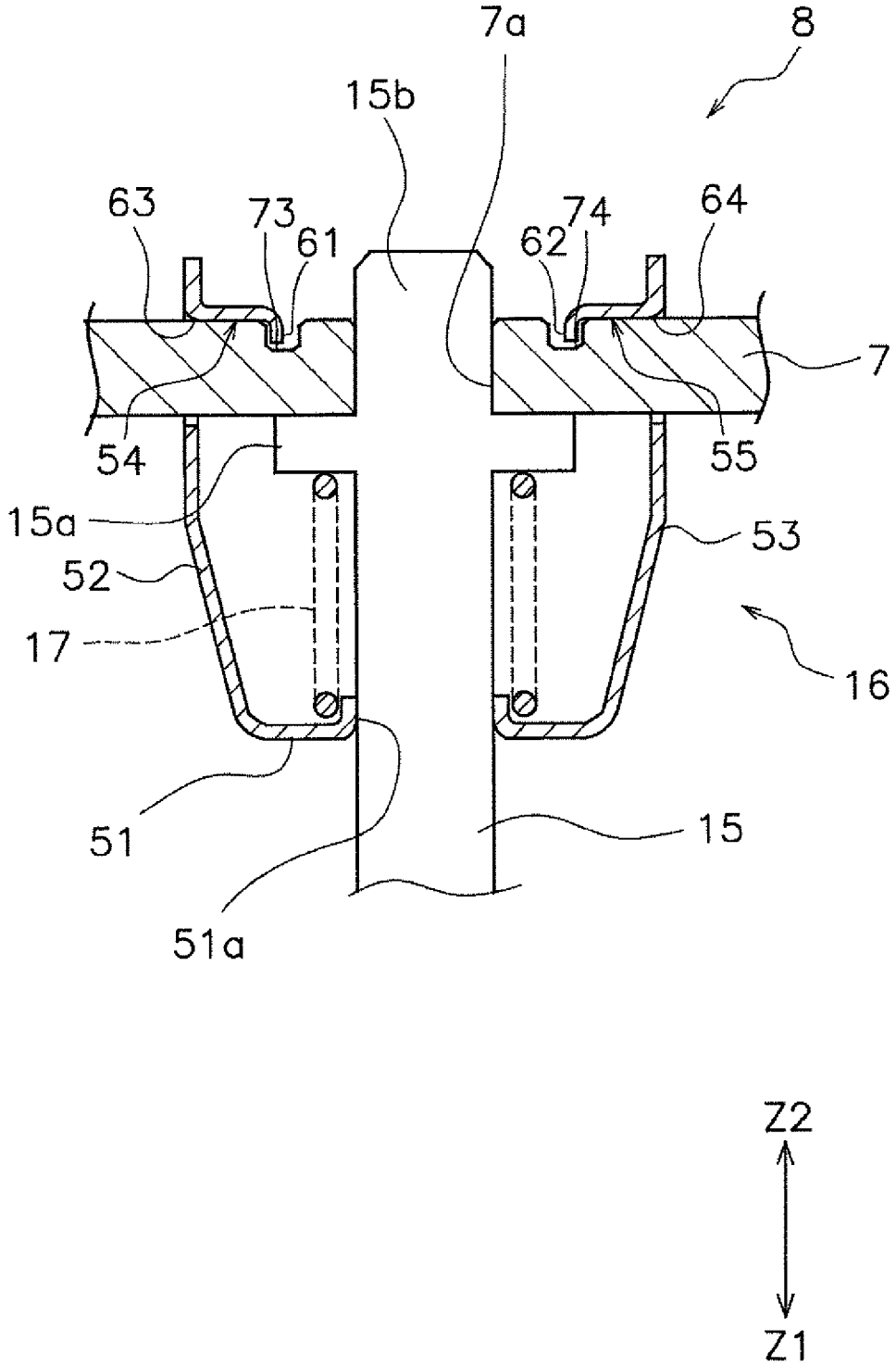
FIG. 13 is a sectional view illustrating the holder according to the sixth modified example.

FIG. 12 is a perspective view of the holder 16 according to a sixth modified example. FIG. 13 is a sectional view of the holder 16 according to the sixth modified example. As illustrated in FIGS. 12 and 13, the first pressing surface 54 may extend inward in the longitudinal direction of the movable touch piece 7 from the first side surface 52. The second pressing surface 55 may extend inward in the longitudinal direction of the movable touch piece 7 from the second side surface 53.

Note that "inward" in the longitudinal direction of the movable touch piece 7 means a direction toward the longitudinal center of the movable touch piece 7. "Outward" in the longitudinal direction of the movable touch piece 7 means a direction away from the longitudinal center of the movable touch piece 7.

Figure 14:
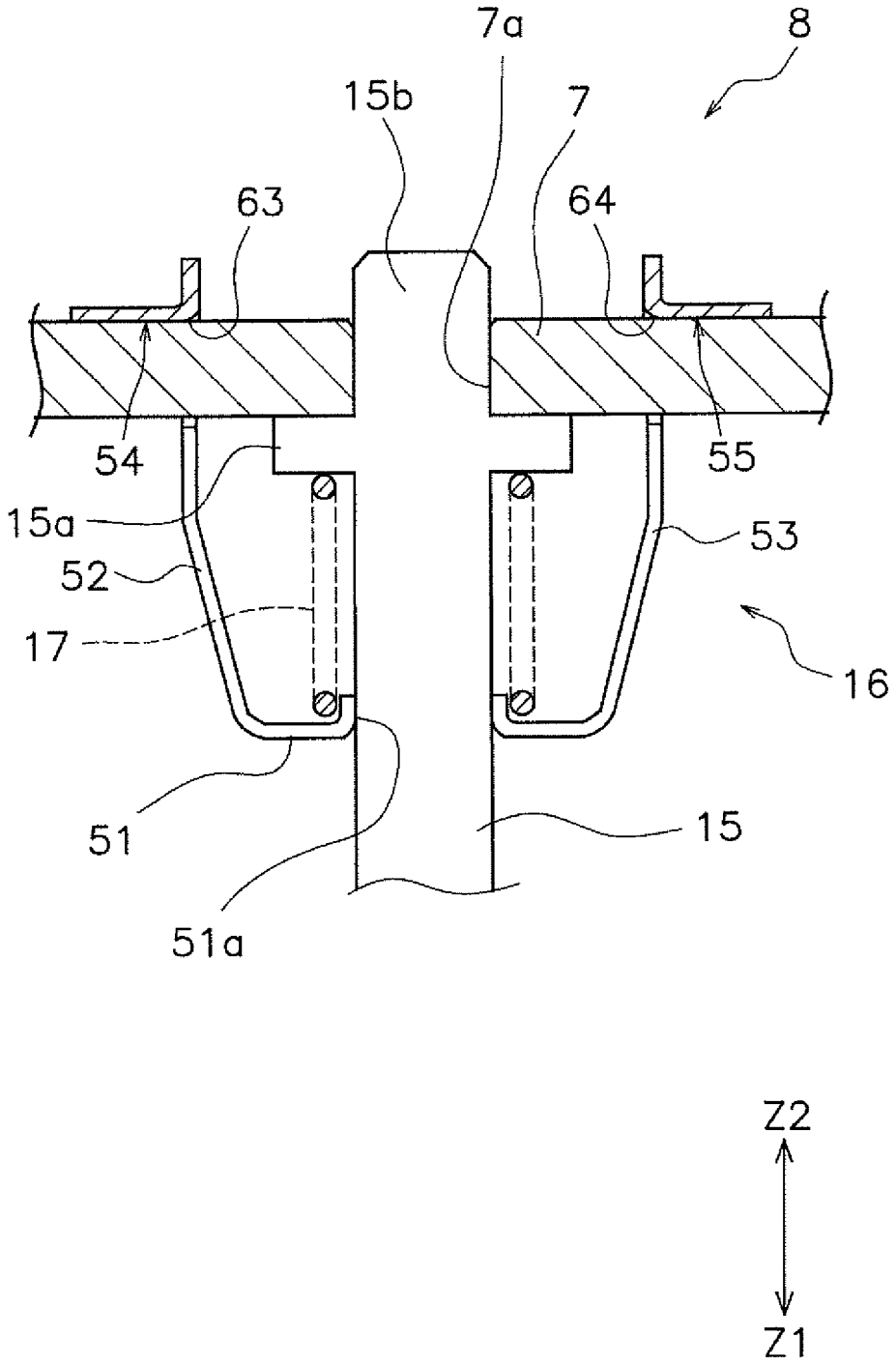
FIG. 14 is a sectional view illustrating a holder according to a seventh modified example.
Figure 15:
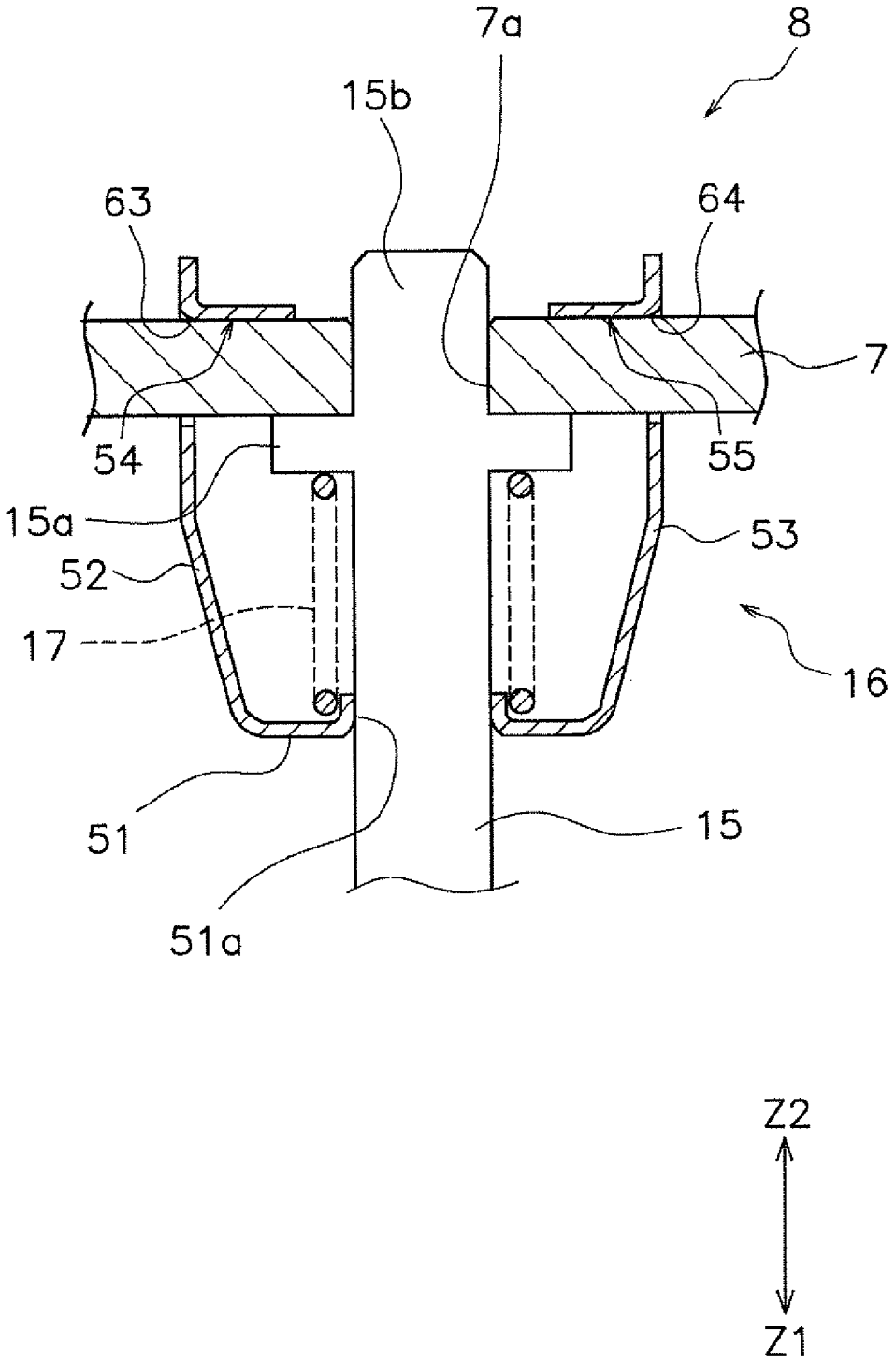
FIG. 15 is a sectional view illustrating a holder according to an eighth modified example.

FIG. 14 is a perspective view of the holder 16 according to a seventh modified example. FIG. 15 is a perspective view of the holder 16 according to an eighth modified example. As illustrated in FIGS. 14 and 15, the first protrusion 61 and the second protrusion 62 may be omitted. In FIG. 14, in the fifth modified example illustrated in FIGS. 10 and 11, the first protrusion 61 and the second protrusion 62 are omitted. In FIG. 15, in the sixth modified example illustrated in FIGS. 12 and 13, the first protrusion 61 and the second protrusion 62 are omitted. However, this is not limited to the fifth modified example and the sixth modified example, and the protrusions may be omitted in the embodiments described above or in the first to fourth modified examples.

According to one or more embodiments of the present invention, it is possible to prevent scraping of a movable touch piece by a holder while preventing an increase in manufacturing cost and a decrease in ease of assembly.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

The invention claimed is:

1. A relay comprising:
a first fixed contact;
a second fixed contact;
a movable touch piece including:
a first movable contact that is disposed facing the first fixed contact, and
a second movable contact that is disposed facing the second fixed contact,
the movable touch piece being disposed so as to be movable in a direction in which the first movable contact and the second movable contact come into contact with the first fixed contact and the second fixed contact and in a direction in which the first movable contact and the second movable contact separate from the first fixed contact and the second fixed contact;
a holder configured to hold the movable touch piece;
a drive shaft directly connected to the holder;
a spring; and
a drive device configured to move the drive shaft in a movement direction of the movable touch piece,
wherein the drive shaft includes a flange portion that is configured to directly contact and support the movable touch piece,
wherein the spring is disposed between the flange portion of the drive shaft and the holder,
wherein the holder includes a pressing surface integrally formed in the holder, and
wherein the pressing surface has a flat shape along a surface of the movable touch piece and comes into surface contact with the movable touch piece to press the movable touch piece.

2. The relay according to claim 1, wherein the pressing surface is formed by bending a part of the holder.

3. The relay according to claim 1,
wherein the holder further includes:
a base that is disposed facing the movable touch piece, and
a side surface extending from the base toward the movable touch piece, and
wherein the holder has a shape bent between the pressing surface and the side surface.

4. The relay according to claim 3,
wherein the side surface is disposed facing a side edge of the movable touch piece, the side edge extending in a longitudinal direction of the movable touch piece, and
wherein the pressing surface extends in a lateral direction of the movable touch piece from the side surface.

5. The relay according to claim 3, wherein the side surface includes an opening through which the movable touch piece is allowed to pass, and wherein the pressing surface extends in a longitudinal direction of the movable touch piece from the side surface.

6. The relay according to claim 3, wherein the pressing surface is disposed across the lateral direction of the movable touch piece from the side surface.

7. The relay according to claim 3, wherein the pressing surface is formed by bending a part of the side surface.

8. The relay according to claim 1,
wherein the holder further includes:
a base that is disposed facing the movable touch piece,
a first side surface extending from the base toward the movable touch piece, a second side surface spaced from the first side surface and extending from the base toward the movable touch piece, and wherein the pressing surface includes:

a first pressing surface extending along the surface of the movable touch piece from the first side surface, and a second pressing surface extending along the surface of the movable touch piece from the second side surface.

9. The relay according to claim 8, wherein the first side surface is disposed facing one side edge of the movable touch piece extending in the longitudinal direction of the movable touch piece, wherein the second side surface is disposed facing the other side edge of the movable touch piece extending in the longitudinal direction of the movable touch piece, wherein the first pressing surface extends in the lateral direction of the movable touch piece from the first side surface, and wherein the second pressing surface extends in the lateral direction of the movable touch piece from the second side surface.

10. The relay according to claim 8, wherein the first side surface includes a first opening through which the movable touch piece is allowed to pass, wherein the second side surface is spaced from the first side surface in the longitudinal direction of the movable touch piece, and includes a second opening through which the movable touch piece is allowed to pass, wherein the first pressing surface extends in the longitudinal direction of the movable touch piece from the first side surface, and wherein the second pressing surface extends in the longitudinal direction of the movable touch piece from the second side surface.

11. The relay according to claim 1, wherein a recessed groove is provided on the surface of the movable touch piece, and wherein the holder includes a protrusion protruding from the pressing surface toward an inside of the recessed groove.

12. The relay according to claim 11, wherein a tip of the protrusion is disposed away from a bottom of the recessed groove.

13. The relay according to claim 2, wherein the holder further includes:

a base that is disposed facing the movable touch piece, and a side surface extending from the base toward the movable touch piece, and wherein the holder has a shape bent between the pressing surface and the side surface.

14. The relay according to claim 4, wherein the pressing surface is formed by bending a part of the side surface.

15. The relay according to claim 5, wherein the pressing surface is formed by bending a part of the side surface.

16. The relay according to claim 6, wherein the pressing surface is formed by bending a part of the side surface.

17. The relay according to claim 2, wherein the holder further includes:

a base that is disposed facing the movable touch piece, a first side surface extending from the base toward the movable touch piece, a second side surface spaced from the first side surface and extending from the base toward the movable touch piece, and wherein the pressing surface includes:

a first pressing surface extending along the surface of the movable touch piece from the first side surface, and a second pressing surface extending along the surface of the movable touch piece from the second side surface.

18. The relay according to claim 2, wherein a recessed groove is provided on the surface of the movable touch piece, and wherein the holder includes a protrusion protruding from the pressing surface toward an inside of the recessed groove.

19. The relay according to claim 3, wherein a recessed groove is provided on the surface of the movable touch piece, and wherein the holder includes a protrusion protruding from the pressing surface toward an inside of the recessed groove.

20. The relay according to claim 4, wherein a recessed groove is provided on the surface of the movable touch piece, and wherein the holder includes a protrusion protruding from the pressing surface toward an inside of the recessed groove.

* * * * *